US005757259A

United States Patent [19]

Fulford et al.

[11] Patent Number: 5,757,259

[45] Date of Patent: May 26, 1998

[54] ANTI-ROTATION DEVICE FOR JOINING A SHELL AND ENCAPSULATED TERMINAL/ COIL SUBASSEMBLY

[75] Inventors: Mark G. Fulford, Peoria; Roy E. Kline, Wadsworth; Jerry A. Wear, East Peoria, all of Ill.

[73] Assignee: Caterpillar Inc., Peoria, Ill.

[21] Appl. No.: 703,560

[22] Filed: Aug. 27, 1996

Related U.S. Application Data

[63] Continuation of Ser. No. 281,886, Jul. 28, 1994, abandoned.

[51] Int. Cl.[6] ..... H01F 27/02

[52] U.S. Cl. ..... 336/92; 335/278; 336/107

[58] Field of Search ..... 335/202, 260, 335/263, 278, 292; 336/90–98, 105, 107, 192

[56] References Cited

U.S. PATENT DOCUMENTS

| | | | |
|---|---|---|---|
| 4,682,136 | 7/1987 | Prokop | 335/282 |
| 4,799,645 | 1/1989 | Kramer et al. | 251/30.04 |
| 4,873,817 | 10/1989 | Harms | 56/10.2 |
| 5,031,663 | 7/1991 | Fukuta et al. | 137/625.64 |
| 5,051,631 | 9/1991 | Anderson | 310/14 |
| 5,060,695 | 10/1991 | McCabe | 137/625.61 |
| 5,067,687 | 11/1991 | Patel et al. | 251/129.08 |
| 5,069,420 | 12/1991 | Stobbs et al. | 251/30.02 |
| 5,121,730 | 6/1992 | Ausman et al. | 123/467 |
| 5,220,301 | 6/1993 | Haas et al. | 335/278 |

OTHER PUBLICATIONS

Article entitled New Electrohyd. Prop. Pressure Relief Valve Cartr., Mobile Hydr. Suppl. to Diesel Eng. Progress Engines & Drives, Mar. 1993, p. 24.

*Primary Examiner*—Michael L. Gellner
*Assistant Examiner*—Raymond M. Barrera
*Attorney, Agent, or Firm*—Anthony N. Woloch; Joseph W. Keen

[57] ABSTRACT

A shell/terminal/coil subassembly adapted for an electrically-controlled proportional fluid pressure control valve assembly. The shell/terminal/coil subassembly comprises an encapsulated terminal/coil subassembly, a shell, and an anti-rotation device for preventing relative rotation movement between the terminal/coil subassembly and the shell. The pressure control valve assembly is adapted for, inter alia, a hydraulically-actuated fuel injector system.

2 Claims, 6 Drawing Sheets

ANTI-ROTATION DEVICE FOR JOINING A SHELL AND ENCAPSULATED TERMINAL/ COIL SUBASSEMBLY

This is a continuation application of application Ser. No. 08/281,886, filed Jul. 28, 1994 now abandoned.

TECHNICAL FIELD

The present invention relates generally to electrically-controlled proportional pressure control valve assemblies and, more particularly to such valve assemblies having an integrally-packaged electrical terminal and coil subassembly.

BACKGROUND ART

A known electrically-controlled proportional pressure control valve assembly having an integrally-packaged terminal and coil subassembly (hereinafter referred to as a terminal/coil subassembly) is shown in U.S. Pat. No. 4,799,645 issued to Kramer et al. on Jan. 24, 1989.

In such terminal/coil subassemblies, the electrical coil and a portion of the electrical terminal connected thereto are encapsulated or embedded in a monolithic electrically non-conductive body. Typically, the encapsulating body is molded or otherwise formed from a plastic material. The encapsulated coil portion of the subassembly is covered by a rigid shell or cover which is typically connected (for example, crimped) to a housing base or adapter. The shell is formed from a metallic, preferably ferro-magnetic, material and has an opening through which the terminal portion of the subassembly extends for releasable connection to a source of electrical power.

During operation of the valve assembly, external sources of vibration and/or differential thermal expansion between the metallic cover and the encapsulated terminal/coil subassembly may cause relative looseness between the cover and the terminal/coil subassembly. If this assembly of components is sufficiently loosened, then the external sources of vibration may cause the terminal/coil subassembly to rotate or oscillate relative to the fixed cover. Such relative movement is undesirable because the metallic edges of the cover defining the cover opening may cut or wear against the plastic neck of the encapsulated terminal portion where it extends through the cover opening. Such wear or cutting action may eventually cause an electrical short or broken electrical wire in the terminal/coil subassembly and thereby make the valve assembly electrically inoperable.

The present invention is directed to overcoming one or more of the problems as set forth above.

DISCLOSURE OF THE INVENTION

In one aspect of the present invention a shell/terminal/coil subassembly is disclosed adapted for an electrically-controlled proportional pressure control valve assembly. The shell/terminal/coil subassembly comprises an encapsulated terminal/coil subassembly having a terminal portion, a coil portion connected to the terminal portion, and a monolithic body encapsulating the coil portion and at least some of the terminal portion. The shell/terminal/coil subassembly further includes a shell covering the coil portion and defining an opening through which the terminal portion extends. The shell/terminal/coil subassembly further includes anti-rotation means for preventing relative rotation movement between the terminal/coil subassembly and the shell.

BEST MODE FOR CARRYING OUT THE INVENTION

Figure 1:
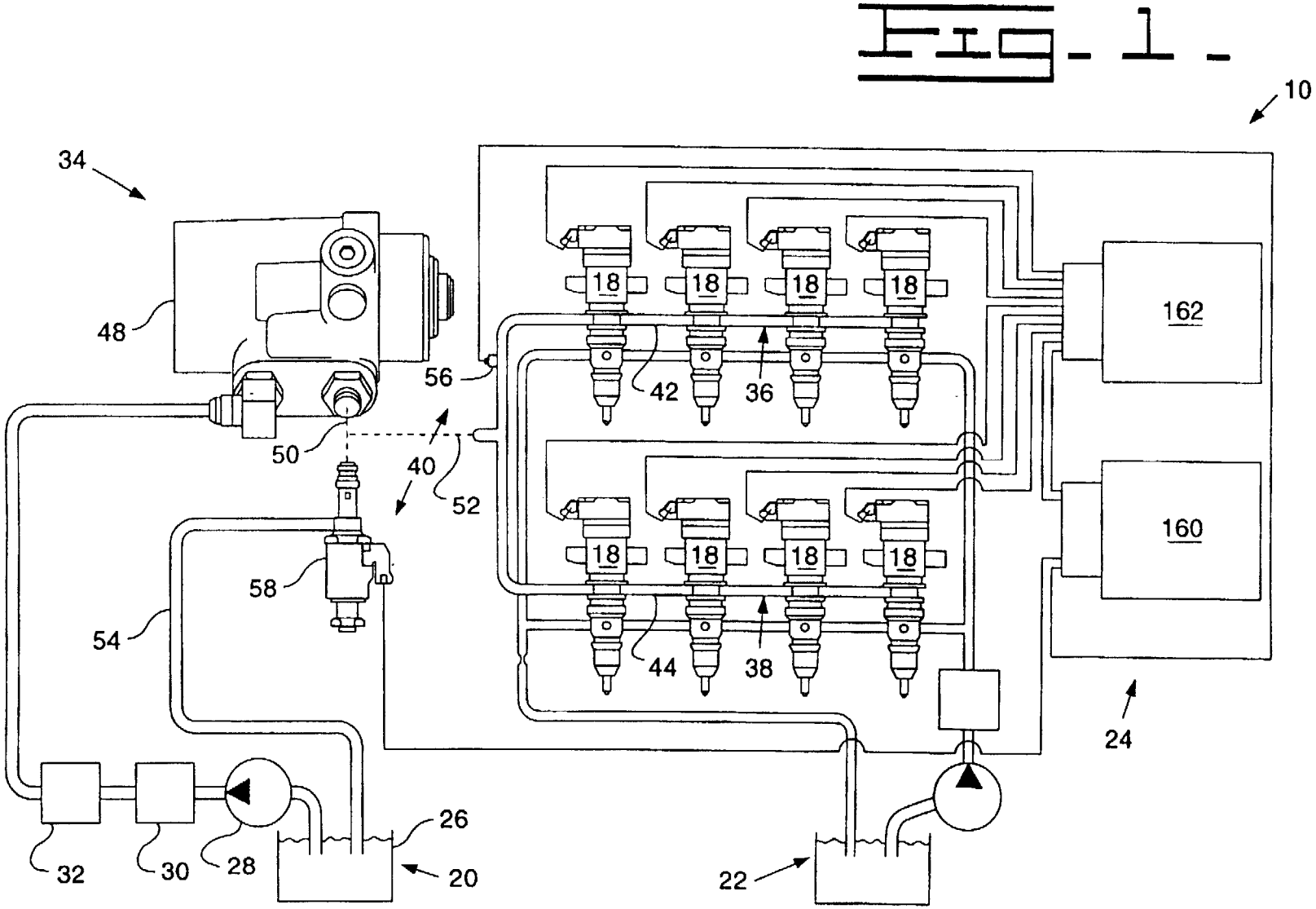
FIG. 1 is a diagrammatic general schematic view of a hydraulically-actuated electronically-controlled injector fuel system for an engine having a plurality of injectors.

Referring to FIG. 1, wherein similar reference numerals designate similar elements or features throughout FIGS. 1–10, there is shown an embodiment of a hydraulically-actuated electronically-controlled injector fuel system 10 (hereinafter referred to as a HEUI fuel system).

The exemplary HEUI fuel system 10 is shown in FIG. 1 as adapted for a direct-injection diesel-cycle internal combustion engine. While the embodiment of FIG. 1 is shown applicable to a vee-type eight-cylinder engine, it should be understood that the present invention is also applicable to other types of engines, such as in-line engines and rotary engines, and that the engine may contain fewer or more than eight cylinders or combustion chambers. Preferably, the engine has at least one cylinder head (not shown) which defines one or more injector bores (not shown).

The HEUI fuel system 10 includes one or more hydraulically-actuated electronically-controlled injectors 18 (for example, unit fuel injectors) adapted to be positioned in a respective injector bore. The system 10 further includes apparatus or actuating fluid supplying means 20 for supplying hydraulically-actuating fluid to each injector 18, apparatus or fuel supplying means 22 for supplying fuel to each injector 18, and apparatus or electronically-controlling means 24 for electronically controlling the fuel injection quantity, injection timing, and/or fuel injection pressure of the injectors 18 independent of engine speed and load. Further details of an exemplary HEUI fuel system 10, generally relating to the instant invention but not teaching or suggesting the instant invention, are disclosed in U.S. Pat. No. 5,191,867 issued to Glassey et al. on Mar. 9, 1993.

The hydraulically actuating fluid supplying means 20 preferably includes an actuating fluid sump 26, a relatively low pressure actuating fluid transfer pump 28, an actuating fluid cooler 30, one or more actuating fluid filters 32, a source or actuating fluid pressurizing means 34 for selectively pressurizing actuating fluid to a variable relatively higher pressure than that delivered to it by the transfer pump 28, at least one relatively high pressure actuating fluid manifold 36,38, and a actuating fluid pressure controlling means 40 for electronically or variably controlling the magnitude of the actuating fluid pressure supplied to the injectors 18 via the manifold(s) 36,38.

Preferably, the fluid chosen for the actuating fluid is not fuel but is a relatively incompressible liquid having a relatively higher viscosity than fuel under the same operating conditions. Preferably, the actuating fluid is engine lubricating oil and the actuating fluid sump 26 is an engine lubrication oil sump, crankcase, or oil pan. Alternatively, the actuating fluid may be fuel.

Preferably, one actuating fluid manifold 36,38 is provided for and associated with each cylinder head having a bank of injectors 18. Each manifold 36,38 accumulates pressurized actuating fluid delivered by the pressurizing means 34 and intermittently feeds such pressurized actuating fluid to an actuating fluid inlet passage of each hydraulically-actuated fuel injector 18 associated with that manifold. Preferably, each actuating fluid manifold 36,38 has one common rail passage 42,44 and a plurality of individual rail branch passages (not shown).

Each common rail passage 42,44 is arranged downstream of the pressurizing means 34 and is in fluid communication between the pressurizing means 34 and the respective bank of injectors 18. The number of rail branch passages for each manifold 36,38 corresponds to the number of injectors 18 positioned in each cylinder head. Each rail branch passage extends between its respective common rail passage 42,44 and an actuating fluid inlet passage of a respective injector 18.

Figure 2:
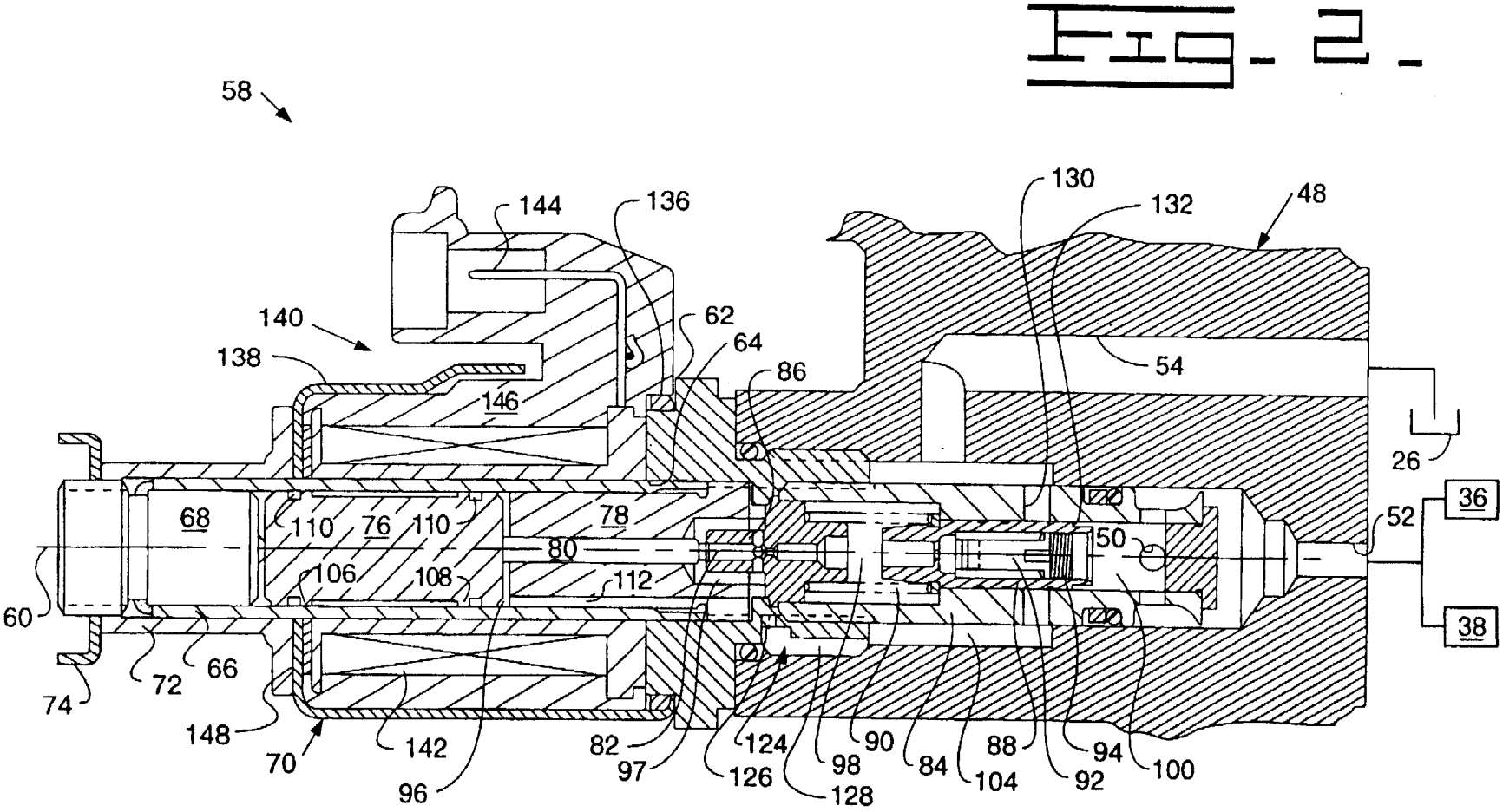
FIG. 2 is a diagrammatic partial cross-sectional view of an embodiment of a proportional pressure control valve assembly and actuating fluid pump generally shown at 58 and 48, respectively, in FIG. 1.

Preferably, the pressurizing means 34 includes an actuating fluid pump 48. For example, the pump 48 may be a gear-driven fixed-displacement axial piston pump 48. As shown in FIG. 2, the actuating fluid pump 48 includes first, second, and third internal passages 50,52,54. The first passage 50 is adapted to be in fluid communication with the relatively high pressure pumping chamber(s) of the pump 48. The second passage 52 or manifold pressure chamber is adapted to be in continuous fluid communication with each of the manifolds 36,38. The third passage 54 is adapted to be in continuous fluid communication with the relatively low pressure actuating fluid sump 26.

As shown in FIGS. 1 and 2, preferably, the actuating fluid pressure controlling means 40 includes at least one actuating fluid pressure sensor or transducer 56 and a proportional pressure control valve assembly 58 also hereinafter called a rail pressure control valve assembly or "RPCV". Preferably, the sensor 56 is positioned in one of the manifolds 36,38 downstream of the pump 48 but upstream of all the injectors 18 in the actuating fluid flowpath. Preferably, the RPCV 58 is of the pilot-operated type if it must be capable of operating with relatively high fluid pressures. Alternatively, the RPCV may be of the single-stage type if it operates only with relatively low fluid pressures. Preferably, the RPCV 58 is adapted to be installed in the backplate or portplate of the pump 48. As shown in FIG. 1, the RPCV 58 is adapted to selectively bypass a variable amount of actuating fluid from the relatively high pressure pump 48 back to the relatively low pressure sump 26 via the passage 54.

Figure 3:
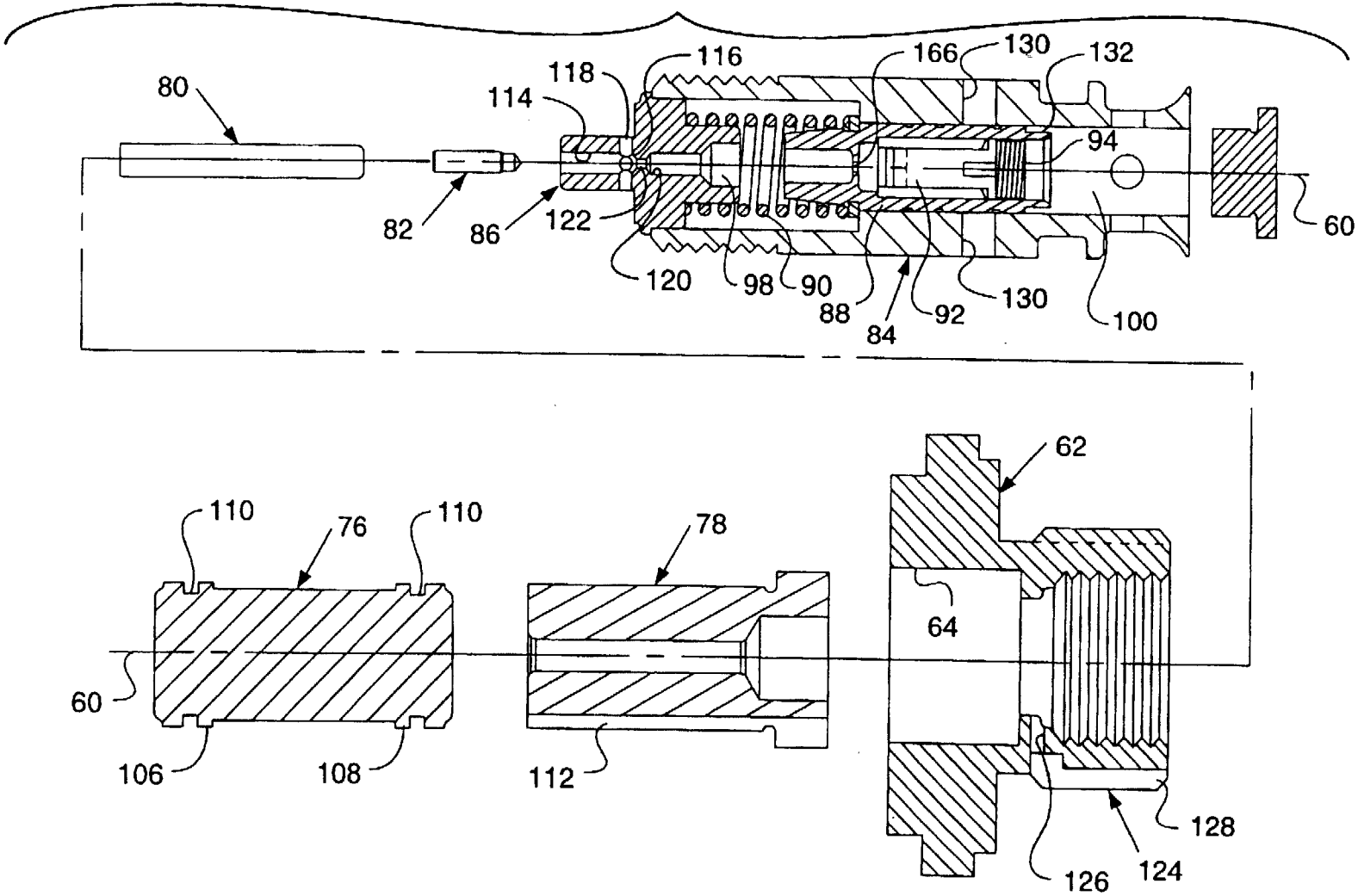
FIG. 3 is a diagrammatic exploded enlarged partial cross-sectional view of some of the components of the proportional pressure control valve assembly 58 shown in FIG. 2.
Figure 4:
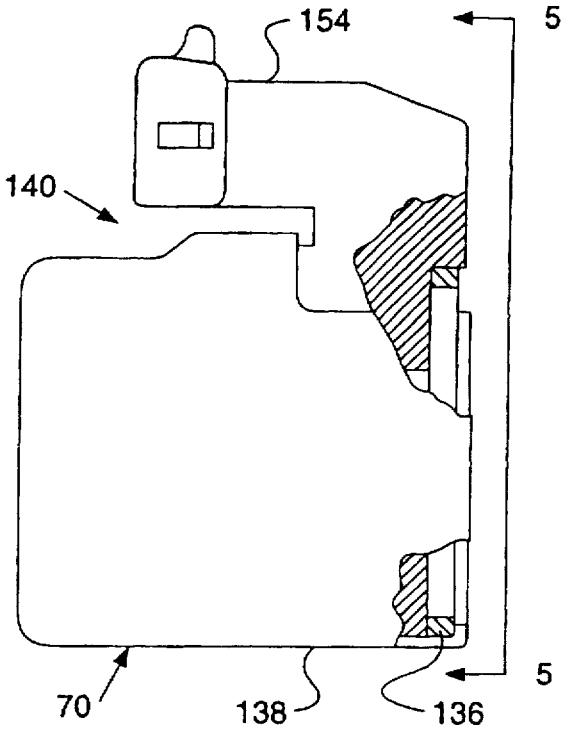
FIG. 4 is a diagrammatic isolated partial cross-sectional view of a shell/terminal/coil subassembly shown in FIG. 2.
Figure 5:
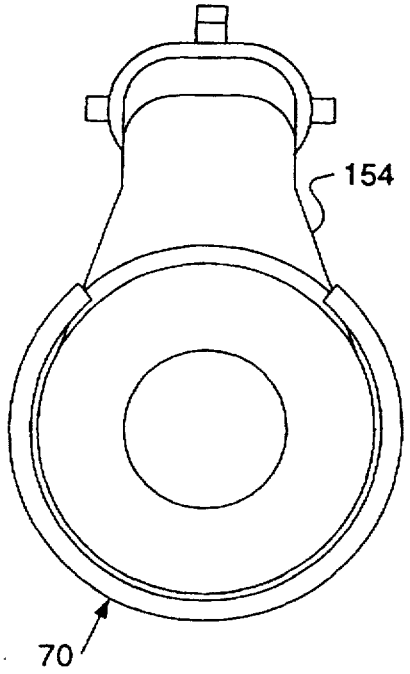
FIG. 5 is a diagrammatic end view of the shell/terminal/coil subassembly taken along line 5—5 of FIG. 4.
Figure 6:
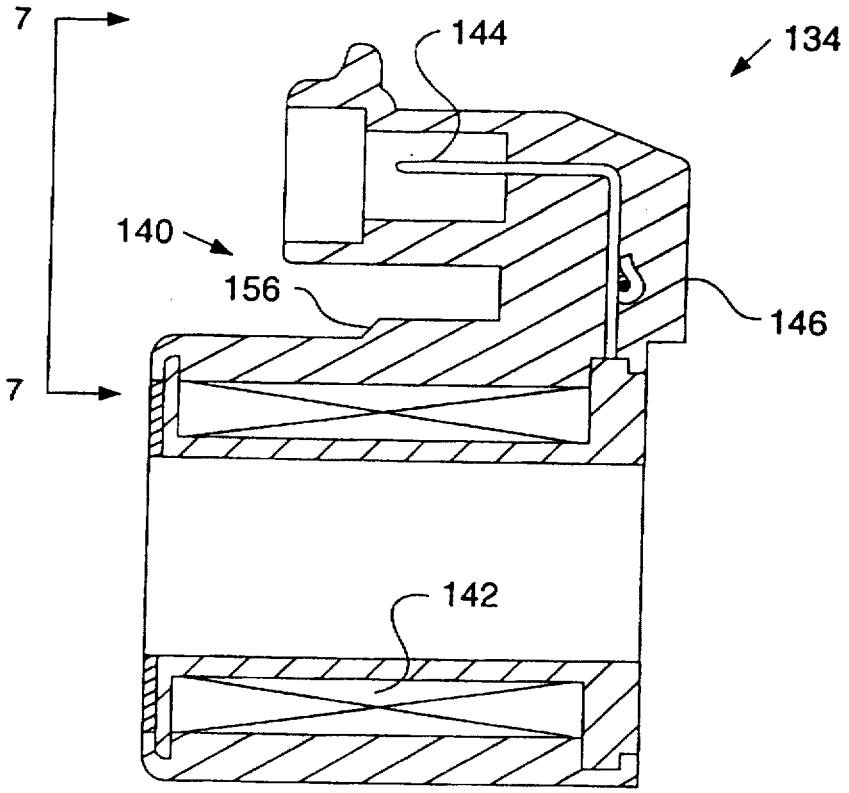
FIG. 6 is a diagrammatic isolated partial cross-sectional view of a terminal/coil subassembly shown in FIG. 2.
Figure 7:
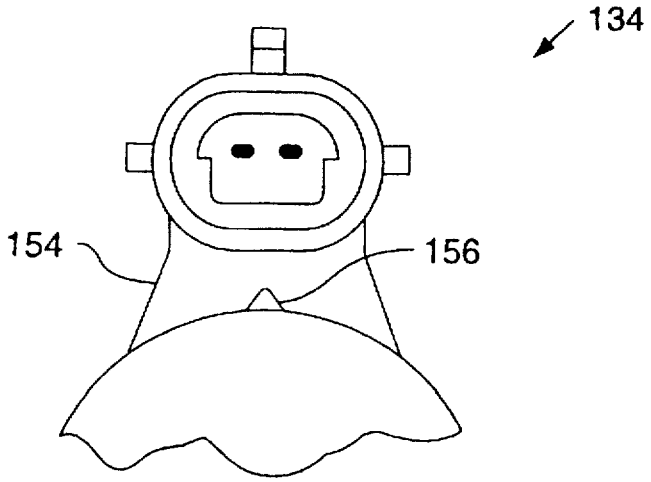
FIG. 7 is a diagrammatic partial end view of the terminal/coil subassembly taken along line 7—7 of FIG. 6.
Figure 8:
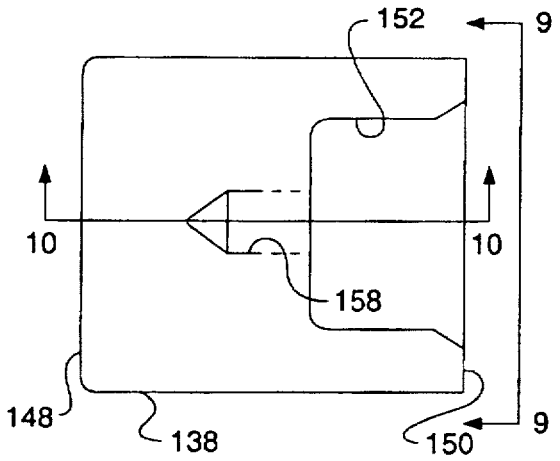
FIG. 8 is a diagrammatic isolated view of a shell shown in FIG. 2.
Figure 9:
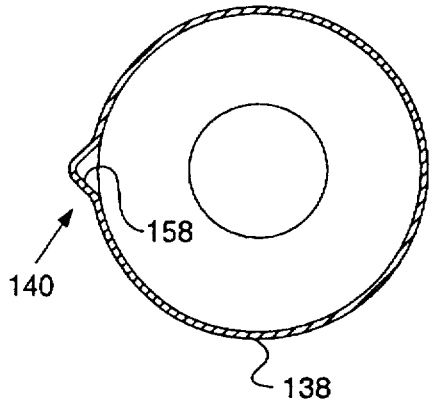
FIG. 9 is a diagrammatic end view of the shell taken along line 9—9 of FIG. 8.
Figure 10:
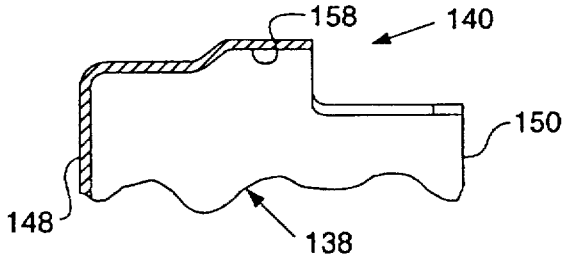
FIG. 10 is a diagrammatic enlarged partial cross-sectional view of the shell taken along line 10—10 of FIG. 8.

As shown in FIGS. 2 and 3, the RPCV 58 preferably has a main or central longitudinal axis 60 and includes an adapter 62 having an adapter bore 64, a cylindrical tube 66 connected to the adaptor 62, an imperforate tube stop 68 connected to or integrally formed on one end portion of the tube 66, a combination shell/terminal/coil subassembly 70 positioned by a slip fit concentrically over one portion of the tube 66, a generally cylindrical and hollow spacer 72 positioned by a slip fit concentrically over another portion of the tube 66 wherein the spacer 72 has an enlarged flange end portion abutting the subassembly 70, and a nut 74 threadedly connected to the tube stop 68 and abutting another end portion of the spacer 72. The RPCV 58 further includes an axially-movable armature 76, a stator or pole piece 78 connected to the adapter 62 via a threaded connection to one end portion of the internal wall defining the adapter bore 64, an axially-movable push pin 80, an axially-movable pilot poppet 82, a cage 84 connected to another end portion of the internal wall defining the adapter bore 64, and a poppet seat member 86 sandwiched or otherwise fixed between the adapter 62 and the cage 84. The RPCV 58 further includes an axially-movable spool 88, a first helical compression spring 90, a pilot stage edge filter cartridge 92, and a second helical compression spring 94.

The stator 78 and movable armature 76 collectively define an expandable armature chamber 96. The stator 78 and poppet seat 86 collectively define a pilot pressure chamber 97. The poppet seat 86, one end portion of the spool 88, and the cage 84 collectively define a set pressure chamber 98. The cage 84 and another end portion of the spool 88 collectively define a valve inlet pressure chamber 100. A counterbore of the pump 48 and the cage 84 collectively define a drain chamber 104 arranged in continuous fluid communication with the sump 26 via the third internal passage 54.

Preferably the armature 76 includes a pair of axially-spaced annular lands 106,108 which slidably guide the movable armature 76 within the tube 66. Each land 106,108 defines one or more slots 110. Preferably, the slot(s) are formed across the periphery of the respective land along an imaginary line that is oblique relative to the axis 60. Alternatively, the slot(s) may be formed across the periphery of the respective land 106,108 along an imaginary line that is parallel to the axis 60.

Preferably, the stator 78 includes one or more vent passages 112 arranged in continuous fluid communication between the armature chamber 96 and the pilot pressure chamber 97. Preferably, each vent passage 112 is a slot extending across the outer surface of the stator 78 generally along the axis 60.

The poppet seat member 86 includes a central axial blind bore 114 slidably receiving the poppet 82, a frusto-conical seat 116 positioned at the generally closed end portion of the bore 114 wherein the seat 116 is selectively opened or closed by the movable poppet 82, one or more radial passages 118 positioned downstream of the seat 116 and arranged in continuous fluid communication with the pilot pressure chamber 97, and a restricted internal passage 120. Preferably, the restricted passage 120 defines a restricted fixed orifice 122. Preferably, the orifice 122 is positioned in the passage 120 adjacent to and upstream of the seat 116 and intersects the generally closed end portion of the blind bore 114. The restricted passage 120 is arranged in continuous fluid communication with the set pressure chamber 98. The movable poppet 82 selectively closes and opens fluid communication between the set pressure chamber 98 and the pilot pressure chamber 97 depending upon whether the seat 116 is closed or opened by the poppet 82.

Preferably, the adapter 62 includes a restricted pilot drain passage 124 arranged in continuous fluid communication with the sump 26 via the drain chamber 104 and the passage 54. Preferably, the passage 124 includes a pilot drain orifice 126, extending radially outwardly from the adapter bore 64 to the outer periphery of the adapter 62, and a peripheral drain slot 128 intersecting the orifice 126.

The restricted pilot drain passage 124 provides several advantages for improved operation of the RPCV 58. First, the restricted passage 124 helps isolate and thereby stabilize the fluid pressure in the pilot pressure chamber 97 from the relatively-lower-pressure drain passages leading to the sump 26. Second, the restricted passage 124 maintains the pressure in the armature chamber 96 and pilot pressure chamber 97 at a predetermined level (preferably, slightly pressurized) such that any air entrained in the actuating fluid will stay in solution at least until the actuating fluid exits the RPCV 58. Thus, no air bubbles are formed in the chambers 96,97 which could cause erratic unstable operation. Third, the restricted passage 124 creates a hydraulic lock in the chambers 96,97 thereby restricting or inhibiting actuating fluid from draining from the chambers 96,97 after the HEUI fuel system 10 is shutoff. Thus, air does not need to be purged from the chambers 96,97 at the next startup in order to resume stable operation. Fourth, the restricted passage 124 effectively lowers the pressure gain across the restricted passage 120 of the poppet seat 86 by maintaining a minimum pressure level in the armature chamber 96. The restricted passage 120 also provides a stabilizing effect during transient operation. For example, if the poppet 82 suddenly lifts from the poppet seat member 86 at high fluid pressure, a large transient pilot flow is produced. This transient pilot flow creates additional pressure in the chambers 96,97 which further lowers the pressure gain across the restricted passage 120 and thus stabilizes the RPCV 58.

The cage 84 includes one or more radially-extending drain passages or ports 130. Preferably, the spool 88 has a reduced diameter end portion or annulus 132 facing the valve inlet pressure chamber 100 which selectively registers with the drain passages 130 of the cage 84.

Referring to FIGS. 2 and 4–10, the shell/terminal/coil subassembly 70 includes an integrally-packaged terminal/coil subassembly 134, a flux ring 136, a protective shell 138 which covers the coil portion of the subassembly 70, and an anti-rotation means or device 140 for preventing relative rotation or movement between the terminal/coil subassembly 134 and the shell 138.

The terminal/coil subassembly 134 includes an annular electrical coil 142 and an electrical terminal 144 embedded in the same or common monolithic electrically non-conductive body 146. Preferably, the body 146 is molded or otherwise formed from an imperforate plastic material such as 30%-by-weight-glass-reinforced polyethylene terephthalate. Such plastic material is commercially available, for example, from E. I. Dupont De Nemours & Co. Inc. which named its product Rynite 530.

Preferably, the shell 138 is generally cylindrically shaped and has a closed end portion 148 and an open end portion 150. The open end portion 150 of the shell 138 defines an opening 152 through which a neck 154 of the body 146 extends. Preferably, the shell 138 is made from a ferromagnetic material such as steel.

As shown in FIGS. 6–10, the anti-rotation means 140 includes at least one elongated axially-extending protuberance or projection 156 formed on either an external surface of the body 146 or an internal surface of the shell 138. The anti-rotation means 140 further includes at least one complementary slot or groove 158 formed on the other of the body 146 or shell 138. Preferably, the protuberance 156 has a generally triangular cross-section when the protuberance is cross-sectioned by a plane oriented perpendicular to the axis 60. Likewise, the slot 158 has a generally vee-shaped cross-section when the slot 158 is cross-sectioned by a plane oriented perpendicular to the axis 60. The generally vee-shaped cross-section of the slot 158 is generally complementary with or conforms to the generally triangular cross-section of the protuberance 156 so that the protuberance 156 mates with or slidably fits into the slot 158 parallel to the axis 60 to prevent relative rotation between the body 146 and the shell 138. Preferably, the protuberance 156 is formed on the external surface of the body 146. Preferably, the slot 158 is formed on the inside of the shell 138 adjacent to the opening 152. Alternatively, other complementary shapes may be used for the slot(s) and protuberance(s). Optionally, the anti-rotation means 140 may include an axial interference, wedging, or tapered fit between the slot 158 and the protuberance 156 in order to further prevent axial rotation, as well as other relative movement, between the body 146 and the shell 138.

Referring to FIG. 1, the means 24 for electronically controlling the fuel injection quantity, injection timing, and/or fuel injection pressure of the injectors 18 preferably includes a electronic control module 160 or digital microprocessor (hereinafter referred to as an "ECM") and an electronic driver unit 162 (hereinafter referred to as an "EDU"). The ECM 160 includes software decision logic and information defining optimum fuel system operational parameters and controls both the RPCV 58 and the injectors 18. One or more sensor signals, indicative of various engine parameters, are delivered to the ECM 160 to identify the engine's current operating condition. The ECM 160 uses these input signals to control the operation of the injectors 18 in terms of fuel injection quantity, fuel injection timing, and fuel injection pressure independent of engine speed and load. The ECM 160 is electrically connected to the EDU 162 and the EDU 162 is electrically connected to the solenoid or another type of electrical actuator of each injector 18 in order to electronically control each injector 18. The sensor 56 is electrically connected to the ECM 160 in order to provide signals indicative of the magnitude of the actuating fluid pressure in the manifolds 36,38.

Industrial Applicability

Referring to FIG. 1, the actuating fluid supplying means or circuit 20 includes a relatively low fluid pressure portion between the sump 26 and the pump 48 and a relatively high fluid pressure portion between the pump 48 and the injectors 18. The low fluid pressure portion of the circuit 20 may, for example, operate at a pressure of about 0.3 MPa (about 44 psi). Its function is to provide filtered actuating fluid, preferably in the form of lubricating oil, to the high pressure actuating fluid pump 48 as well as to the lubricating oil system of the engine. The transfer pump 28 draws actuating fluid from the sump 26 and supplies it through the oil cooler 30 and filter(s) 32 to both the engine and the high pressure actuating fluid pump 48.

The pump 48 increases the actuating fluid pressure level from a typical engine operating oil pressure level to the actuation pressure level required by the injectors 18. The RPCV 58 is electronically controlled by the ECM 160 to control the actuating fluid pressure effectively provided by the pump 48 to the manifold(s) 36,38. The RPCV 58 selectively causes a variable portion of the actuating fluid pressurized by pump 48 to bypass the manifold(s) 36,38 and return directly back to the sump 26.

An exemplary software decision logic will now be discussed for determining the magnitude of the actuating fluid pressure supplied to the injectors 18. This logic preferably uses at least four inputs: actual engine speed, desired fuel quantity, actual actuating fluid pressure and actuating fluid viscosity which may be directly or indirectly sensed.

Preferably, at least an actual engine speed signal, a desired fuel quantity signal, and an actuating fluid viscosity signal are the inputs for an actuating fluid pressure map and/or equation(s). Alternatively, an air inlet pressure signal may be added as an input. Based on these three or more input signals, a desired actuating fluid pressure signal is selected as an output. This desired actuating fluid pressure signal then is compared with an actual actuating fluid pressure signal to produce an actuating fluid pressure error signal. This actuating fluid pressure error signal and the desired actuating fluid pressure signal become the inputs for a set of mathematical equations and/or maps called the RPCV control algorithm whose output is a desired electrical current.

This desired electrical current is applied to the coil 142 of the RPCV 58. By changing the magnitude of the electrical current supplied to the RPCV 58, the actuating fluid pressure in the manifold(s) 36,38 can be increased or decreased. For example, increasing the magnitude of the electrical current supplied to the RPCV 58 causes the RPCV 58 to bypass the actuating fluid directly to the sump 26 at a higher fluid pressure thereby increasing the actuating fluid pressure in the manifolds 36,38. Decreasing the magnitude of the electrical current supplied to the RPCV 58 causes the RPCV 58 to bypass more actuating fluid to the sump 26 at a lower fluid pressure thereby decreasing the actuating fluid pressure in the manifolds 36,38. This RPCV control algorithm calculates the magnitude of the electrical current supplied to the RPCV 58 that would be needed to raise or lower the actuating fluid pressure to result in a zero, or substantially zero, actuating fluid pressure error signal. The resulting actuating fluid pressure in the manifold(s) 36,38 is used to intermittently hydraulically actuate the injectors 18. Preferably, the raw actuating fluid pressure signal, sensed in the high pressure portion of the actuating fluid pressure circuit such as in the manifold 36, is conditioned by conventional electronic means to eliminate noise and convert the signal into a form usable by the ECM 160.

The high pressure portion of the circuit 20, which principally includes the manifolds 36,38 and the injectors 18, provides actuation fluid to the injectors 18 and operates in a predetermined pressure range, for example, from about 4 to 23 MPa (about 580 to 3300 psi). This high pressure actuating fluid flows through internal passages or external lines into a respective manifold 36,38 located near the injectors 18. Each manifold 36,38 accumulates the actuating fluid at a variable (i.e., adjustable) actuation pressure and supplies such pressurized actuating fluid to the injectors 18 for hydraulic actuation thereof.

Preferably, when the actuating fluid used is lubrication oil, the low pressure actuating fluid which is exhausted from the injector 18 is discharged under an engine valve cover (not shown). No special return lines are required back to the sump 26 since such actuating fluid may return to the sump 26 via conventional lubrication oil passages which commonly exist under the engine valve cover. Alternatively, such fluid may be recirculated through a recirculation line (not shown), regulated by a waste actuating fluid control valve, to a hydraulic motor (not shown) which drives the actuating fluid pump 48.

The combination of the actuating fluid pressure sensor 56, the ECM 160, and the RPCV 58 variably controls the magnitude of the actuating fluid pressure in the manifolds 36,38 supplying the injectors 18. This, in turn, variably controls the magnitude of the pressure of the fuel injected by the injectors 18 independent of engine speed and load. Predetermined operational maps and/or mathematical equations stored in the programmable memory of the ECM 160 identify the optimum actuating fluid pressure required in the manifolds 36,38 for optimum engine performance. Varying the magnitude of the actuating fluid pressure in turn varies the speed of the hydraulically-actuated fuel injection pump plunger (not shown) associated with a respective injector 18 independent of engine speed. The ECM 160 operates the RPCV 58 in a predetermined closed loop control strategy using input signals from the actuating fluid pressure sensor 56. Preferably for accuracy, this pressure sensor 56 is located in at least one of the actuating fluid manifolds 36,38 and is calibrated at the nominal engine operating temperature. Alternatively, one or more pressure sensors 56 may be located elsewhere in the high pressure portion of the actuating fluid circuit 20 between the pumping outlet portion of the pump 48 and the hydraulically-actuated injectors 18.

Preferably, the RPCV 58 is an electronically-controlled pilot-operated fluid pressure control valve. The RPCV 58 controls pump 48 outlet pressure within a predetermined range, for example about 4 to 23 MPa (about 580 to 3300 psi). An electrical signal delivered by the ECM 160 to the coil 142 creates a magnetic field which applies a variable force (directly proportional to the amount of electrical current applied) on the poppet 82 to control actuating fluid pressure.

When the engine is not operating, the spool 88 is biased to its closed position (i.e., to its rightward position according to FIG. 2) by the return spring 90. In its closed position, the spool 88 blocks or closes the drain passages 130.

A predetermined starting actuating fluid pressure is required to start the engine. For example, this starting actuating fluid pressure may be in the range of about 5 to 10 MPa (725 to 1450 psi) for mild temperature starting conditions. For colder starting conditions, the starting actuating fluid pressure is preferably chosen to be higher (for example, in the range of about 10 to 15 MPa/1450 to 2175 psi). During cranking of the engine, the ECM 160 sends an electrical signal to the RPCV 58 to provide a minimum predetermined actuating fluid pressure in the manifolds 36,38. Since the drain passages 130 are blocked by the spool 88, all pump flow of actuating fluid is directed to the manifold(s) 36,38 in order to rapidly build up fluid pressure there.

The actuating fluid flow through the RPCV 58 during engine startup will now be described. Actuating fluid delivered by the pump 48 enters via the passage 50 into an end portion of the RPCV 58 and a relatively small portion flows into the set pressure chamber 98 through the pilot stage edge filter cartridge 92 and control orifice 166 located in the spool 88. The electronic signal causes the coil 142 to generate a magnetic field which corresponds in strength to the magnitude of the electrical current applied to the coil 142. The resultant magnetic field or force displaces the axially-movable armature 76 towards the stator 78 (i.e., towards the rightward direction according to FIG. 2). The moving armature 76 contacts and displaces the axially-movable push pin 80. Consequently, the moving push pin 80 contacts and displaces the poppet 82 (i.e., towards the rightward direction according to FIG. 2) so that the poppet 82 seats against the seat 116 of the poppet seat member 86. Since the passage 120 is closed by the seated poppet 82, fluid pressure increases in the set pressure chamber 98. The net force due to the force of the spool spring 90 the pressure in the set pressure chamber 98 holds the spool 88 in a closed position (i.e., all the way to the right according to FIG. 2) thereby blocking the drain passages 130. Thus, all actuating fluid delivered by the pump 48 is communicated to the manifold (s) 36,38 until the minimum predetermined starting actuating fluid pressure is reached.

Once the engine starts, the ECM 160 sends an electrical signal to the RPCV 58 to modulate or variably select the actuating fluid pressure in the manifolds 36,38 as desired according to operating conditions. The actuating fluid pressure sensor 56 monitors actual fluid pressure in the manifolds 36,38. The ECM 160 compares the actual manifold pressure to the desired manifold pressure and adjusts the magnitude of the electrical signal (i.e., electrical current) applied to the RPCV 58 in order to obtain the desired manifold pressure.

The actuating fluid flow through the RPCV 58 during normal engine operation following engine startup will now be described. Actuating fluid delivered by the pump 48 enters the valve inlet manifold pressure chamber 100 of the RPCV 58 and a relatively small portion flows into the set pressure chamber 98 through the pilot stage edge filter 164 and control orifice 166 located at an end portion of the spool 88. The fluid pressure in the set pressure chamber 98 is controlled by adjusting the magnitude of the electrical current applied to the coil 142 which in turn adjusts the amount of force acting rightward on the poppet 82 and allowing the poppet 82 to bleed off some of the actuating fluid in the set pressure chamber 98. The rightward force acting on the poppet 82 is controlled by the strength of the magnetic field produced in direct proportion by the amount of electrical signal sent by the ECM 160 to the coil 142. The left-hand or relatively lower pressure side of the spool 88 responds to fluid pressure changes in the set pressure chamber 98 by changing its axial position in order to maintain a net balance between forces acting on the right and left sides or opposed surfaces of the spool 88. The axial position of the spool 88 determines how much cross-sectional area of the drain passages 130 are unblocked by the spool 88. The amount of open cross-sectional fluid flow area in the drain passages 130 helps determine how much actuating fluid is bled off from the pump outlet and returned to the sump 26 via passage 54. The amount of actuating fluid bled off from the pump outlet, in turn, modulates the actuating fluid pressure in the manifolds 36,38. In practice, the process of responding to fluid pressure changes on either side of the spool 86 occurs so rapidly that the spool 88 shuttles axially back and forth about a partially-open position relative to the drain passages 130 so that the outlet pressure of the pump 48 is closely controlled. The RPCV 58 allows infinitely variable control of the actuating fluid pressure at the pump outlet and the manifold(s) within a predetermined range. For example, the predetermined range may be about 4 to 23 MPa (about 580 to 3300 psi).

The annulus 132 defined on the spool 88 provides several advantages. First, the annulus is viscosity sensitive. In other words, for a given actuating fluid flow, a relatively higher pressure drop is created at relatively higher viscosities (i.e., relatively low temperatures) of the actuating fluid than at relatively lower viscosities (i.e., relatively high temperatures) of the actuating fluid. Second, the annulus 132 provides an additional fluid flow restriction and thus lowers the area gain of the RPCV 58 under relatively high viscosity (i.e., relatively low temperature) conditions. Thus, the adjusted actual actuating fluid pressure does not undershoot or overshoot the desired pressure as much when the response of the spool 88 is slow. This provides stable operation of the RPCV 58 under cold actuating fluid conditions. Third, under normal (i.e., relatively hot temperature, low viscosity) conditions, the fluid flow restriction provided by the annulus 132 is relatively small compared to the restriction provided by the spool 88 and passage(s) 130. Therefore, the restriction provided by the annulus 132 has negligible effect on the performance of the RPCV 58 under normal operating conditions. Fourth, the geometry or size and shape of the annulus 132 can be variably selected to produce adequate restriction under relatively high viscosity conditions and minimal restriction under relatively low viscosity conditions. Fifth, the annulus 132 of the spool 88 provides stable actuating fluid pressure control of the HEUI fuel system 10 over a wide range of viscosities and temperatures.

The anti-rotation means 140 is provided for preventing relative rotation movement between the terminal/coil subassembly 134 and the shell 138 during engine operation. Thus, the metallic edges of the shell 138 defining the shell opening 152 are prevented from cutting or wearing against the plastic neck 154 of the encapsulated terminal portion where it extends through the shell opening 152. As a result, the occurrence of an electrical short or break in the electrical wire 142,144 of the terminal/coil subassembly 134 is minimized and helps ensure continued electrical operability of the valve assembly 58.

Other aspects, objects, and advantages of this invention can be obtained from a study of the drawings, the disclosure, and the appended claims.

We claim:

1. A shell/terminal/coil subassembly adapted for an electrically-controlled proportional pressure control valve assembly, said shell/terminal/coil subassembly comprising:

an encapsulated terminal/coil subassembly having a terminal portion, a coil portion connected to the terminal portion, and a monolithic body encapsulating the coil portion and at least some of the terminal portion and having an external surface, a shell substantially covering the coil portion and having an internal surface, said shell defining an opening through which the terminal portion extends and having an edge which is engageable with the monolithic body during relative rotation of said terminal/coil subassembly and said shell; and wherein a protuberance is formed on one of said body external surface and shell internal surface and a complementary slot independent of said shell's edge defined on the other of said body external surface and said shell internal surface, said protuberance being engageable with the slot to prevent said relative rotation independent of said shell engaging said monolithic encapsulated terminal portion.

2. An electrically-controlled proportional fluid pressure control valve assembly adapted for a hydraulically-actuated fuel injector system, said pressure control valve assembly comprising:

an encapsulated terminal/coil subassembly having a terminal portion, a coil portion connected to the terminal portion, and a monolithic body encapsulating the coil portion and at least some of the terminal portion and having an external surface, a shell substantially covering the coil portion, said shell defining an opening through which the terminal portion extends and having an internal surface, and anti-rotation means for preventing relative rotation movement between the terminal/coil subassembly and the shell, said terminal/coil subassembly, shell, said anti-rotation means including a protuberance formed on one of said external surface and internal surface and a complementary slot defined on the other of said external surface and said internal surface, said protuberance being engageable with the slot independent of said shell engaging said monolithic encapsulated terminal portion.

* * * * *